US006604563B1

(12) United States Patent
Gray

(10) Patent No.: US 6,604,563 B1
(45) Date of Patent: Aug. 12, 2003

(54) MULTIPLE BILL COMPARTMENT WALLET

(76) Inventor: Johney L. Gray, G7347 N. Vassar Rd., Otisville, MI (US) 48463

( * ) Notice: Subject to any disclaimer, the term of this patent is extended or adjusted under 35 U.S.C. 154(b) by 0 days.

(21) Appl. No.: 10/078,297

(22) Filed: Feb. 20, 2002

(51) Int. Cl.[7] ..... A45C 1/06

(52) U.S. Cl. ..... 150/137; 150/140; 150/143; 150/152; 229/72

(58) Field of Search ..... 150/132, 137, 150/140, 143, 147, 152; 229/72

(56) References Cited

U.S. PATENT DOCUMENTS

| | | | | | |
|---|---|---|---|---|---|
| 1,033,578 | A | * | 7/1912 | Greenberg | 150/143 X |
| 1,228,251 | A | * | 5/1917 | Smith | 150/132 |
| 1,269,247 | A | * | 6/1918 | Aslin | 150/132 |
| 1,316,615 | A | * | 9/1919 | Hocking | 150/143 |
| 2,455,515 | A | | 12/1948 | Miller | 150/137 |
| 2,634,777 | A | * | 4/1953 | Berger | 150/147 |
| 2,658,545 | A | | 11/1953 | Weydener et al. | 150/137 |
| 2,718,911 | A | * | 9/1955 | Solomon | 150/147 |
| 2,719,557 | A | | 10/1955 | Bell | 150/137 |
| 2,746,503 | A | * | 5/1956 | Knee | 150/137 X |
| 2,802,502 | A | | 8/1957 | Seamon | 150/137 |
| 3,266,544 | A | | 8/1966 | Snyder | 150/137 |
| 5,184,657 | A | * | 2/1993 | Hatchman | 150/140 X |

FOREIGN PATENT DOCUMENTS

| | | | | |
|---|---|---|---|---|
| AT | 50906 | * | 11/1911 | 150/143 |
| CH | 564328 | * | 7/1975 | 150/143 |
| FR | 1357428 | * | 2/1964 | 150/137 |
| GB | 719345 | * | 12/1954 | 150/137 |

* cited by examiner

*Primary Examiner*—Sue A. Weaver
(74) *Attorney, Agent, or Firm*—John J. Swartz

(57) ABSTRACT

A wallet including a single strip of material including a plurality of oppositely folded and integrally attached panels which extend in directions opposite the adjacent panels to provide a series of outwardly opening paper currency receiving compartments. A closure, integral with at least one of the panels, is detachably coupled to one of the endmost panels in the stack.

17 Claims, 2 Drawing Sheets

MULTIPLE BILL COMPARTMENT WALLET

BACKGROUND OF THE INVENTION

1. Field of the Invention

This invention relates to a multiple compartment wallet and more particularly to a wallet formed with a single strip of material having a plurality of oppositely opening compartments and a pair of closures for detachably, selectively closing the compartments.

2. Background of the Invention

Wallets have been provided heretofore, such as that illustrated in U.S. Pat. No. 2,455,515, issued to Samuel Miller on Dec. 7, 1948, and U.S. Pat. No. 3,266,544, issued to B. L. Snyder on Aug. 16, 1966, each of which discloses the concept of a plurality of compartments for holding currency of differing denominations.

The prior art wallets are generally fabricated from a plurality of individual panels which are assembled in stacked relation. The stacking and assembly of individual panels adds to the expense of manufacture. Accordingly, it is an object of the present invention to provide a new and novel multi-compartment wallet having a plurality of stacked panels that are integral.

For various reasons, it is desirable to have the capacity to detachably close selected compartments of the wallet. Accordingly, it is another object of the present invention to provide a new and novel wallet including new and novel closures for precluding the inadvertent separation of adjacent stacked panels forming money receiving compartments.

Still another object of the present invention is to provide a wallet of the type described which includes a pair of end panels on opposite ends of a pluality of intermediate panels and a closure on one of the end panels detachably coupled to the opposite end panel to inhibit spreading movement of the end panels.

It has been found desirable to sometimes fasten one of the intermediate panels to one of the end panels. Accordingly, it is yet another object of the present invention to provide a multiple compartment wallet of the type described which includes a pair of end panels, a plurality of intermediate panels sandwiched between the end panels, and a closure coupled to one of the intermediate panels detachably coupled to one of the end panels.

A further object of the present invention is to provide a wallet of the type described including a closure flap integrally with, but partially cut from, one of the intermediate panels and including a cooperating fastener mechanism on the flap and one of the end panels for detachably coupling one of the intermediate panels to one of the end panels.

A still further object of the present invention is to provide a multi-compartment wallet of the type described including a pair of new and novel closures.

It is another object of the present invention to provide a one-piece multi-compartment wallet of the type described, one of which includes an integral closure extension tab of one of the end panels detachably coupled to the other end panel and a second closure which is integrally coupled to one of the intermediate panels and detachably coupled to the other end panel.

Still another object of the present invention is to provide a one-piece multi-compartment wallet of the type described in which the second closure is integral with the intermediate panel next adjacent to the one end panel having the integral closure tab.

Yet another object of the present invention is to provide a new and novel one-piece multi-compartment wallet formed from a single elongate sheet which is alternately oppositely folded along its length at a plurality of folded junctions to provide a plurality of stacked sheet sections and cooperating fasteners on one of the upstream sheet sections detachably coupled to the endmost downstream sheet section.

These and other objects of the present invention will become more readily apparent as the description thereof proceeds.

SUMMARY OF THE INVENTION

A wallet comprising a one-piece elongated sheet of material extending in a zig-zag course to provide a plurality of sheet sections integrally joined to adjacent sheet sections at a plurality of folded junctions to define a plurality of open-ended bill compartments which are open-ended alternately in opposite directions for receiving stacks of folded currency therein; the plurality of sheet sections include two opposite end sheet sections and a plurality of intermediate sheet sections sandwiched there-between; and detachably coupled cooperating fastener mechanism on one of the upstream sheet sections detachably and the endmost down stream sheet section.

BRIEF DESCRIPTION OF THE DRAWINGS

The invention may more readily be understood by reference to the accompanying drawings, in which.

DESCRIPTION OF PREFERRED EMBODIMENT

Figure 1:
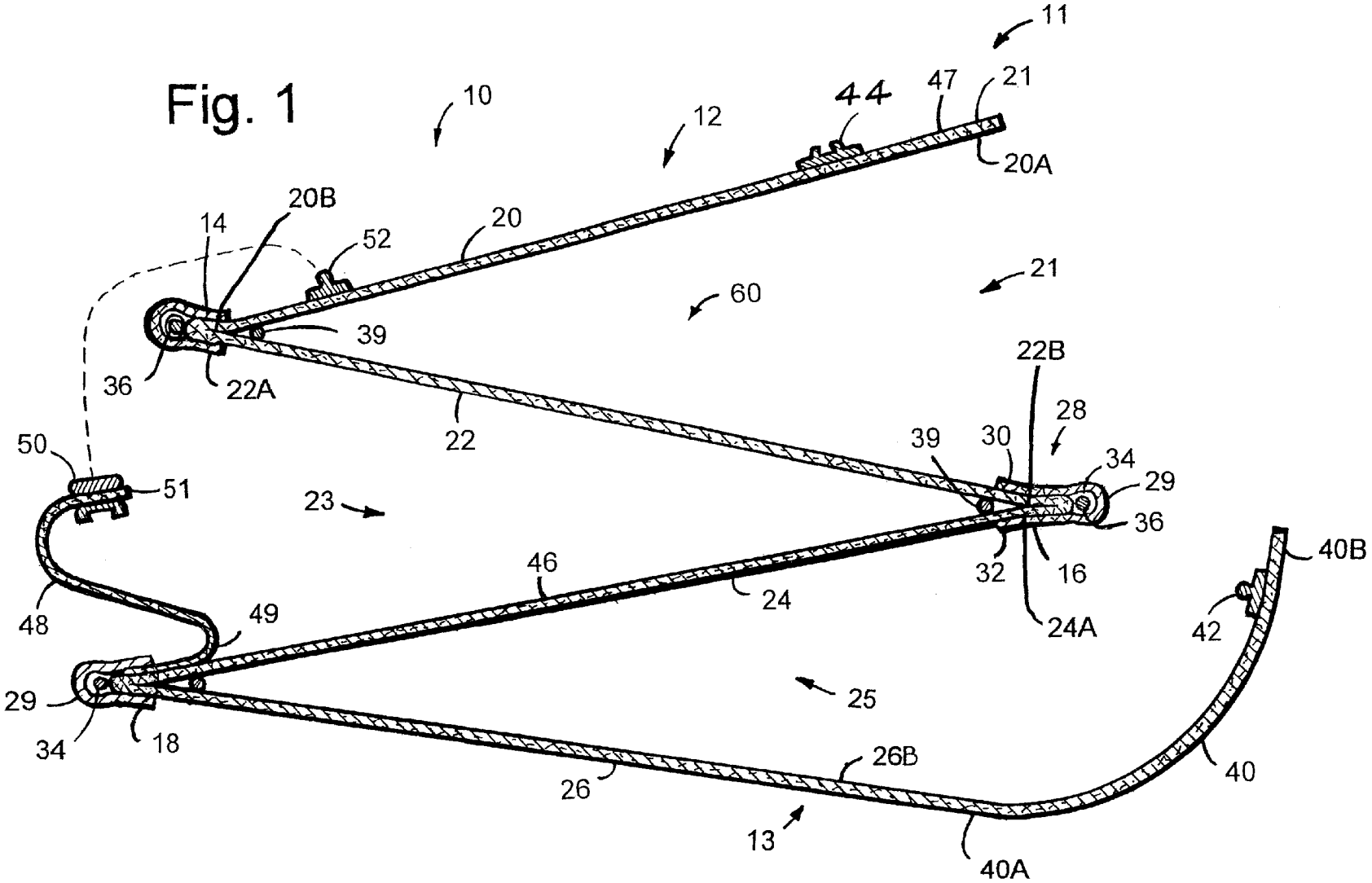
FIG. 1 is a sectional side view of a wallet constructed according to the present invention.
Figure 2:
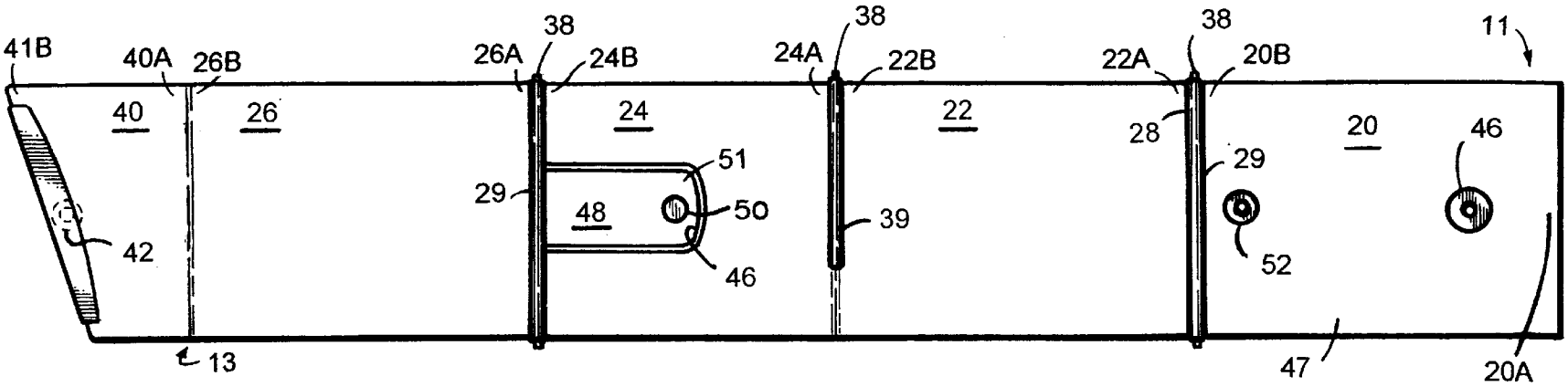
FIG. 2 is a top plan view of the wallet illustrated in FIG. 1 in a rolled out flattened condition prior to assembly as illustrated in FIG. 1.

A wallet, generally designated 10, constructed according to the present invention, comprises an elongate single sheet, generally designated 12, of flexible leather having an upstream end, generally designated 11, and a down stream end, generally designated 13. The elongate sheet or strip 12 includes a plurality of longitudinally disposed integral panels or sheet subsections 20, 22, 24 and 26. The panels 20, 22, 24 and 26 include upstream ends 20A, 22A, 24A and 26A, respectively, and down stream ends 20B, 22B, 24B and 26B, respectively. As illustrated, the down-stream end 20B, 22B and 24B of each panel 20, 22, 24, respectively, is integrally coupled to the upstream end 22A, 24A and 26A, respectively, of an immediately adjacent down-stream panel 22, 24 and 26, respectively, via fold junctions 14, 16 and 18, respectively. When assembled, the upstream front endmost panel 20 and the down-stream rearmost end panel 26 are disposed on opposite ends of the wallet 10 and sandwiched there-between are the intermediate panels 22 and 24. The sheet 12 when folded to the position illustrated in FIG. 1 extends in a zig zag course.

Each of the fold junctions 14, 16 and 18 are held together in the folded positions illustrated in FIG. 1 via a U-shaped channel, generally designated 28, having a base 29 mounting a pair of confronting leg 30 and 32 which grip or clamp opposite sides of the fold junctions 14, 16 and 18 and hold the fold junctions in the positions illustrated in FIG. 1. The channels 28 are typically formed of bendable metal such that the legs 30 and 32 are clamped to opposite sides of the folds 14, 16 and 18 to hold them in the positions illustrated in FIG. 1 clamping the confronting upstream portion, such as 22A, to the down-stream portion 20B of the adjacent upstream panel 20. The channel bases 29 are spaced from the fold junctions 14, 16 and 18 to provide transverse opening or passages 34 laterally outwardly beyond the fold junctions 14, 16 and 18. Each transverse passage 34 receives receiving one leg 36 of a U-shaped or hairpin shaped money clip, generally designated 38, that has an integral opposing confronting leg 39 disposed laterally inwardly beyond the fold junctions 14, 16 and 18.

The confronting panels 20, 22, 24 and 26 cooperate, when folded to the positions illustrated in FIG. 1, to define longitudinally spaced apart, transversely outwardly opening, bill receiving compartments 21, 23 and 25, respectively, which are open ended alternately in opposite directions for receiving stacks of folded paper currencies in different denominations such as, for example, $1.00, $5.00 and $10.00. The currency is received between the legs 39 of the money clips, which are received in the bill receiving compartments 21, 23 and 25, and the confronting folds 14, 16 and 18 to detachably hold the folded currency therebetween. The money clip 38 is constructed of yieldable material to allow the leg 39 to spring outwardly relative to the opposing money clip leg 36 to receive and hold any selected number of folded bills.

The sheet 12 includes a first down-stream closure designated 40, having an upstream end 40A integrally formed with the down-stream end 26B of panel 26 to provide an extension thereof which extends around the next succeeding panel 24 and the remaining panels 20 and 22 and includes a terminal end 40B which will be disposed in confronting relation with the upstream end 20A of the upstream panel 20. The down-stream terminal end 40B mounts a male closure button fastener 42 which is detachably received in a complimentary formed female fastener 44 fixed to one face 47 of the upstream panel 20.

A second closure flap 48 is provided on the intermediate panel 24 next adjacent the down-stream end panel 26. The closure flap 48 is formed by a U-shaped cut out or opening 46 provided in the panel 24 along all but one end 49 which remains integral with the panel 24. The second closure flap 48 includes a free terminal end 51 which is of sufficient length as to pass around the opposite ends of the next succeeding upstream panel 22 and the endmost upstream panel 20 to be disposed in confronting relation with the down-stream end 20B of the face 47 of panel 20. The terminal end 51 mounts a female fastener 50 which is detachably coupled to a complimentary formed male fastener 52 fixed to the face 47 of the upstream panel 20.

THE OPERATION

To utilize the wallet, the male fastener 42 of flap 40 is detached from the female fastener 44 of panel 20 to provide access to money compartments 21 and 25. Folded bills of different denominations can be placed in compartments 21 and 25 and received by the bail or yieldable leg 39 of the money clip disposed in compartments 21 and 25. If access is desired to compartment 23, the second fastener 50 on flap 48 is detached from the male fastener 52 to allow access to the compartment 23 and money held by the yieldable leg 39 of the money clip.

After money is suitably inserted into the compartments or removed therefrom, the flaps 40 and 48 are again restored to positions in which the male fasteners 42 and 52 are detachably received by the female fasteners 46 and 50 respectively.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A multiple fold paper currency storage wallet comprising:

a plurality of inter-coupled, confronting panels including a pair of end panels and a plurality of intermediate panels sandwiched between said end panels;

each of said plurality of intermediate panels having one end coupled to an adjacent end of an adjacent confronting panel on one side thereof and an opposite end coupled to an adjacent end of an adjacent confronting panel on the opposite side thereof;

one of said end-most panels having first fastener means thereon;

one of said intermediate panels having a tab cut therefrom but integrally coupled thereto along a portion thereof and extending outwardly and around said plurality of panels; and second fastener means formed complementally to said first fastener means on said tab for detachably coupling said one intermediate panel to said one end panel.

2. The wallet set forth in claim 1 including an extension flap integral with the other of said end panels extending outwardly around said intermediate panels; and additional fastener means on said extension flap for detachably mating with said fastener means on said one end panel.

3. A wallet comprising:

a stack of sheets, having opposite ends and opposite faces, of pre-determined length and width disposed in stacked relation;

one end of each sheet being coupled to one adjacent end of a sheet adjacent one of its faces;

the other end of each sheet being coupled to the other end of a sheet adjacent the other one of its faces;

said stack of sheets including a pair of opposite end sheets and a plurality of intermediate sheets disposed therebetween;

one of said intermediate sheets having a flap cut therefrom which flap remains integral with said one intermediate sheet along only one end of said flap;

said flap including a free terminal end, opposite said one end of said flap, which extends around and confronts one of said end sheets; and cooperating fastener means on said flap and said one end sheet detachably coupled together.

4. The wallet set forth in claim 3 wherein said end sheets each include a terminal end extending in the same direction; a closure tab integrally coupled to the terminal end of the other of said end sheets and extending around and disposed in confronting relation with said terminal end of said one end sheet; and additional cooperating fastener secure on said tab and said terminal end of said one end sheet detachably coupled together.

5. The wallet set forth in claim 4 wherein said one intermediate sheet comprises the intermediate sheet immediately adjacent said other end sheet.

6. The wallet set forth in claim 5 wherein said flap is cut from said one intermediate sheet adjacent an end of said one end sheet opposite said free terminal end.

7. A multi-compartment wallet having a plurality of separate compartments for storing a plurality of paper currencies of different denominations, said wallet comprising:

a single sheet of flexible material including first and second opposite end panels, and a plurality of integral intermediate panels disposed between and integrally coupled to, said first and second end panels in a zig-zag fashion to define a plurality of open-ended currency receiving compartments there-between, alternate ones of said compartments being open-ended in opposite directions;

one of said intermediate panels including a closure flap cut therefrom and coupled to said one intermediate panel along only one end of said flap and having an opposite terminal free end disposed in confronting relation with one of said end panels; and fastener means detachably coupling said terminal free end and said one end panel.

8. A paper currency storage wallet comprising:

a zig-zag strip of material including a plurality of flexible panels, each of said panels having an front upstream end and a rear down-stream end joined to a rear down-stream end and a front upstream end, respectively, of an immediately preceding upstream panel and an immediately succeeding down-stream adjacent panel, respectively;

each of said flexible panels extending down-stream in a direction opposite the down-stream direction of each of said immediately preceding upstream panel and each of said immediately succeeding down-stream panels to provide a series of longitudinally spaced-apart, transversely outwardly opening currency receiving compartments;

alternate ones of said currency receiving compartments opening in opposite transverse directions;

a plurality of money clips provided at the junctions of said front upstream ends and said down-stream ends of said panels; and first closure means, integral with at least one of said panels, for detachably coupling at least said one panel to another upstream one of said panels other than the panel immediately next preceding said one panel;

said one panel comprising the last downstream one of said panels and said another upstream one of said panels comprises the first upstream one of said panels; said closure means comprising an integral extension on the down-stream terminal end of said last downstream one of said panels folded around the remaining panels and disposed in confronting relation with said first upstream one of said panels; said integral extension and said fist upstream one of said panels including first and second cooperating fastener means detachably coupled together; and second closure means comprising a tab having one free terminal end partially severed from one of said panels between said first upstream one of said panels and said last down-stream one of said panels and a second opposite end integral with said one panel between said first upstream one of said panels and said last down-stream one of said panels;

said one free terminal end of said tab being disposed in confronting relation with said first upstream one of said panels; said second closure means comprising cooperating fastener means on said first upstream one of said panels and said free terminal end of said tab detachably coupled together.

9. The wallet set forth in claim 8 wherein said one panel between said first upstream one of said panels and said last downstream one of said panels comprises the panel immediately adjacent said last downstream one of said panels.

10. The wallet set forth in claim 9 wherein said one free terminal end of said tab is upstream of said second opposite end of said tab.

11. A paper currency storage wallet comprising:

a zig-zag strip of material including a plurality of flexible panels, each of said panels having an front upstream end and a rear down-stream end joined to a rear down-stream end and a front upstream end, respectively, of an immediately preceding upstream panel and an immediately succeeding down-stream adjacent panel, respectively;

each of said flexible panels extending down-stream in a direction opposite the down-stream direction of each of said immediately preceding upstream panel and each of said immediately succeeding down-stream panels to provide a series of longitudinally spaced-apart, transversely outwardly opening currency receiving compartments;

alternate ones of said currency receiving compartments opening in opposite transverse directions;

a plurality of money clips provided at the junctions of said front upstream ends and said down-stream ends of said panels; and closure means, integral with at least one of said panels, for detachably coupling at least said one panel to another up-stream one of said panels other than the panel immediately next preceeding said one panel;

said zig-zag strip of material being a single unitary piece and said front upstream ends and said rear down-stream ends of said adjacent panels being integral;

said closure means being integral with at least one of said panels, and comprising first and second fastener means on the first upstream one of said panels;

an integral extension flap on the said zig-zag strip of material integral with the downstream end of the last downstream one of said panels, said flap having a terminal end disposed in confronting relation with said first upstream one of said panels; and third fastener means on said terminal end of said flap, formed complemental to said first fastener means, detachably coupled to said first fastener means;

a tab partially severed from the panel next adjacent said last downstream panel but integrally coupled thereto along a portion thereof and including a terminal end disposed in confronting relation with said first upstream one of said panels; and fourth fastener means formed complemental to said second fastener means, on said terminal end of said tab detachably coupled to said second fastener means.

12. A wallet comprising:

a one-piece elongate sheet of material extending in a zig-zag course to provide a plurality of sheet sections integrally joined to adjacent sheet sections at a plurality of folded junctions to define a plurality of open-ended bill compartments which are open-ended alternately in opposite directions for receiving separate stacks of folded currency therein;

said plurality of sheet sections including two opposite end sheet sections and a plurality of intermediate sheet sections sandwiched between said two opposite end sections;

cooperating fastener means on said two opposite end sheet sections for detachably coupling said two opposite end sheet sections together to preclude separation thereof; and additional cooperating fastener means on said one end sheet section and one of said intermediate sheet sections for detachably coupling said one intermediate sheet section to said one end sheet section to preclude separation thereof.

13. A wallet comprising:

a one-piece elongate sheet of material extending in a zig-zag course to provide a plurality of sheet sections integrally joined to adjacent sheet sections at a plurality of folded junctions to define a plurality of open-ended bill compartments which are open-ended alternately in opposite directions for receiving separate stacks of folded currency therein;

said plurality of sheet sections including two opposite end sheet sections and a plurality of intermediate sheet sections sandwiched between said two opposite end sections; and cooperating fastener means on said two opposite end sheet sections for detachably coupling said two opposite end sheet sections together to preclude separation thereof;

one of said intermediate sheet sections includes a fastener portion partially severed therefrom but integrally coupled thereto and of such length as to pass around and overly one of said end sheet sections.

14. The wallet set forth in claim 13 including cooperating fastener means on said fastener portion and said one end sheet section detachably coupled together.

15. A wallet comprising:

an elongate strip of flexible material, having front and rear ends, folded along its length at a plurality of longitudinally spaced apart junctions to provide a series of successive integral panels between said junctions;

each of said panels having front and rear ends integrally coupled to the rear and front ends, respectively, of each immediately preceding panel and each immediately succeeding panel, respectively, in said series of successive integral panels;

each of said panels extending down-stream in a direction opposite the down-stream direction of each of said immediately, preceding and immediately succeeding panels to provide a series of longitudinally spaced apart, alternately oppositely transversely outwardly opening currency receiving compartments;

a money clip mounted on said strip at each of said junctions;

each of said clips including a portion extending into one of said compartments for detachably receiving paper currency between said portion and said junctions; and closure means for detachably coupling at least one of said panels to one of the remaining panels other than the panels immediately preceding and succeeding said one panel;

said closure means comprising a strip of said material integral with said one panel and extending about at least a portion of said remaining panels and including a terminal end disposed in fronting relation with the first one of said panels at said front end of said series of panels; and cooperating fastener means on said terminal end of said first one of said panels for detachably coupling said first panel to said last panel;

said strip of material being cut from said one panel along all but one end of said strip.

16. A multiple fold paper currency storage wallet comprising:

a plurality of inter-coupled adjacent, confronting panels with confronting faces to form a stack, said confronting panels including a pair of end panels and a plurality of intermediate panels sandwiched there-between, each of said intermediate panels having one end coupled to an adjacent end of an adjacent confronting panel on one side thereof and an opposite end coupled to an adjacent end of an adjacent panel confronting the opposite side thereof;

one of said end panels at one end of said stack of panels having first fastener means;

the other of said end panels at the other end of said stack having an integral extension flap for folding over said one end most panel; and second fastener means on said extension formed complemental to said first fastener means for detachably coupling said extension flap to said one end most panel;

one of said panels between said first and second end panels including a tab partially severed from said one panel to provide a free terminal end;

a third fastener on said first endmost panel; and a fourth fastener on said tab formed complemental to said third fastener for detachably coupling said one panel to said first endmost panel.

17. The multiple fold paper currency storage device set forth in claim 16 including a U-shaped money clip having a base mounting a pair of legs; one of said legs being sandwiched between adjacent ends of adjacent panels which are coupled together; the other of said legs being received between said adjacent panels for receiving folded currency.

* * * * *